US010610794B1

(12) United States Patent
Ruggiero

(10) Patent No.: US 10,610,794 B1
(45) Date of Patent: Apr. 7, 2020

(54) WATER INFLATABLE SPLASH PAD WITH MOBILE FIGURES

(71) Applicant: Sunny Days Entertainment, LLC, Simpsonville, SC (US)

(72) Inventor: Jim Ruggiero, Simpsonville, SC (US)

(73) Assignee: Sunny Days Entertainment, LLC, Simpsonville, SC (US)

( * ) Notice: Subject to any disclaimer, the term of this patent is extended or adjusted under 35 U.S.C. 154(b) by 0 days.

(21) Appl. No.: 16/588,957

(22) Filed: Sep. 30, 2019

(51) Int. Cl.
*A63G 31/00* (2006.01)
*E04H 4/00* (2006.01)

(52) U.S. Cl.
CPC ..... *A63G 31/007* (2013.01)

(58) Field of Classification Search
CPC ..... A63G 21/00; A63G 21/18; A63G 31/007; A63G 31/12; A63B 2009/008; E04H 4/00; E04H 4/0031
USPC ..... 472/117, 128, 129; 104/69, 70; 4/488, 4/492, 494
See application file for complete search history.

(56) References Cited

U.S. PATENT DOCUMENTS

| | | | | |
|---|---|---|---|---|
| 3,363,268 | A | 1/1968 | Friedlander | |
| 4,982,959 | A | 1/1991 | Rudell et al. | |
| 5,672,123 | A | 9/1997 | Ruddell et al. | |
| 6,062,983 | A * | 5/2000 | Butsook | A63G 21/18 4/488 |
| 6,692,257 | B1 * | 2/2004 | Branum | A63B 69/0002 434/247 |
| 2008/0268971 | A1 * | 10/2008 | Deasy | A63G 21/18 472/117 |

* cited by examiner

*Primary Examiner* — Kien T Nguyen
(74) *Attorney, Agent, or Firm* — Waller Lansden Dortch & Davis, LLP; Matthew C. Cox

(57) ABSTRACT

A water inflatable splash pad includes a base pad and a ring. The ring may be inflated with a liquid such as water from a garden hose. A plurality of spray orifices are defined in the ring, allowing streams of water to be directed upwardly into the air and onto the base pad. One or more moveable objects such as toy figures, glitter, shapes or other novelty objects may be positioned inside the ring. As the water flows through the ring in a clockwise or counterclockwise direction, the objects translate through the ring in the same direction as the flow of water. A transparent surface on the ring allows users to visually observe the figures as they translate through the ring, providing the appearance of motion of the objects.

17 Claims, 5 Drawing Sheets

WATER INFLATABLE SPLASH PAD WITH MOBILE FIGURES

The present invention relates generally to toys for children and more particularly to water inflatable splash pad toys.

Conventional water toys for children include splash pads and splash mats that may be connected to a garden hose or other water source. Such toys include a substantially flat pad or mat forming a playing surface for children to sit or stand. The playing surface is surrounded by a ring that sprays water onto the playing surface. Water from the hose enters the ring through a hose fitting. The water is sprayed in streams from one or more orifices into the air generally directed toward the playing surface. Some water may collect on the playing surface, forming a shallow pool of standing water. Children positioned on the playing surface may be sprayed with water, allowing the children to splash in the water and cool off. Toys of this nature are generally used outdoors in warmer climates as alternatives to swimming pools. Splash pads and splash mats can be used on decks, driveways or in a user's yard.

Some conventional splash pads and splash mats include graphics to provide additional entertainment to children during use. For example, popular children's characters or items may be displayed on the playing surface or the ring. However, such features are generally limited to stationary graphics, and do not provide any type of moving figures or additional motion. What is needed then are improvements in splash pad and splash mat toys for children.

BRIEF SUMMARY

The present invention provides a splash pad toy for children. The splash pad includes a base pad having a playing surface. A ring is positioned on the base pad. The ring includes an interior space configured to receive a liquid, wherein the ring is inflatable using the liquid. A plurality of orifices are defined in the ring, wherein each orifice ejects a stream of the liquid when the liquid flows through the interior space. A first moveable object is disposed inside the interior space in the ring. The first moveable object travels inside the ring when the liquid flows through the interior space. In some embodiments, multiple objects are positioned inside the ring, and are visible as they travel through the ring along with the flow of water.

Another object of the present invention is to provide a splash pad with a transparent ring surface so that users can see the moveable objects travelling through the ring.

A further object of the present invention is to provide a splash pad that can be connected to a standard garden hose.

Yet another object of the present invention is to provide a splash pad with moveable objects inside the ring that simulate animals swimming when water is flowing through the ring.

A further object of the present invention is to provide splash pad that provides entertainment to users by watching and interacting with the moveable objects translating through the ring.

Numerous other objects, features and advantages of the present invention will be readily apparent to those of skill in the art upon a reading of the following disclosure, when taken in conjunction with the accompanying claims.

DETAILED DESCRIPTION

Figure 1:
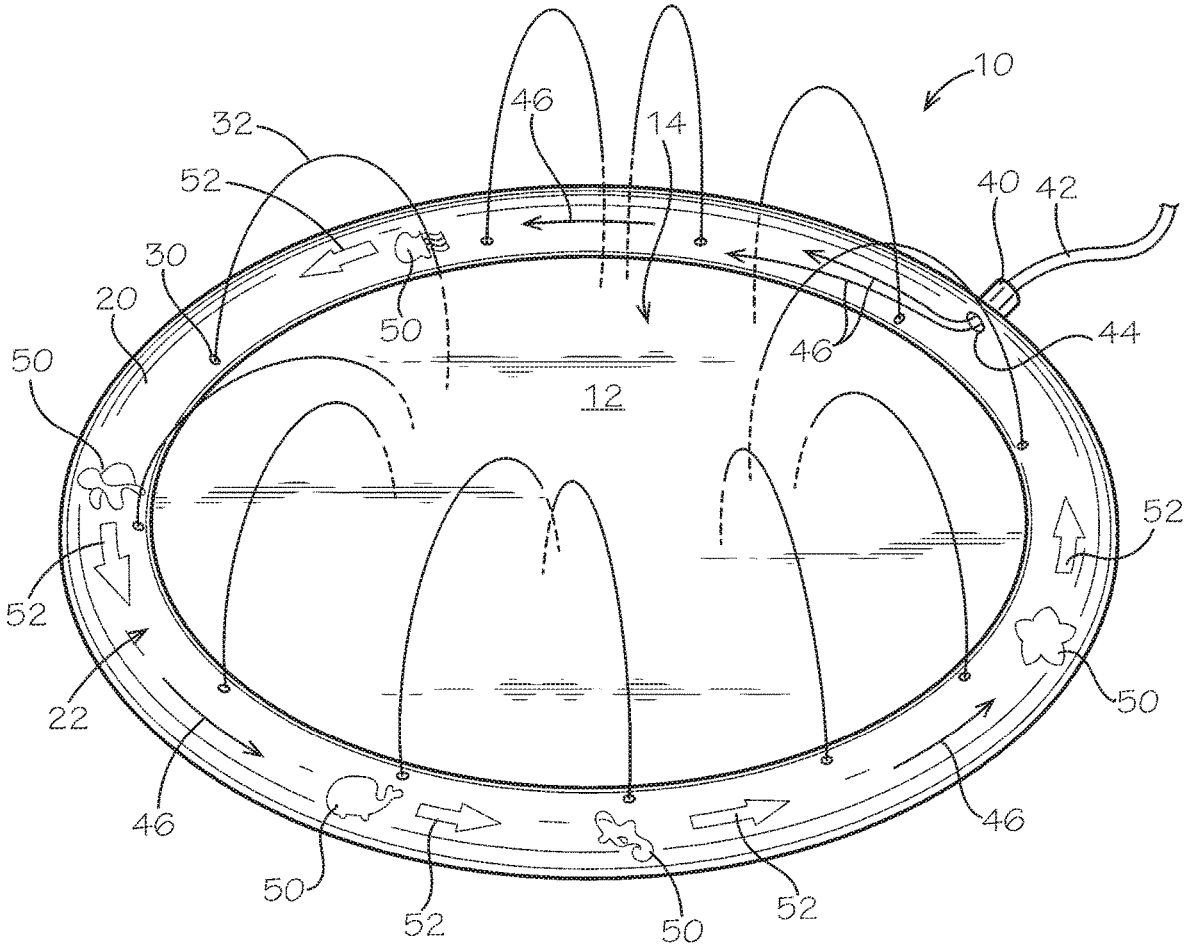
FIG. 1 illustrates a perspective view of an embodiment of a splash pad with mobile interior objects.

Referring now to the drawings, an example embodiment of a splash pad apparatus 10 with mobile interior objects is shown in FIG. 1. Splash pad 10 includes a hoop-shaped ring 20 and a base pad 14. Base pad 14 includes a playing surface 12 on the upper side of the base pad. Although splash pad 10 is shown with a generally round shape in FIG. 1, the apparatus may take any suitable shape including but not limited to an oval shape or a polygonal shape.

Ring 20 has a tubular structure with an interior space 22. Ring 20 is formed from a thin-walled material such as a plastic material. In some embodiments, ring 20 is formed from polyvinylchloride (PVC) or other suitable polymer materials. During use, water may be introduced to the interior space 22 inside ring 20.

A plurality of spray orifices 30 are defined in ring 20. Each spray orifice 30 is positioned on the upper side of ring 20 in some embodiments to allow a stream of water 32 to be sprayed in an upward direction, as shown in FIG. 1. Numerous spray orifices 30 are positioned around the perimeter of ring 20 on the upper side, forming a plurality of streams 32 when water is ejected simultaneously from all or some of the spray orifices 30. The water sprayed from the spray orifices may collect on the playing surface 12 on the base pad 14 surrounded by ring 20.

A hose fitting 40 is disposed on ring 20 in some embodiments. A user may connect a hose 42 to hose fitting 40 to provide an input of water to the interior of ring 20. Hose fitting 40 in some embodiments is configured to attach to a standard threaded garden hose. When a hose 42 is connected to hose fitting 40, water is provided to ring 20. The flow of water inside ring 20 moves in a clockwise or counterclockwise direction. The water provided by the hose 42 travels through the interior of ring 20, and the water is emitted from the plurality of spray orifices 30 positioned around the perimeter of ring 20. The direction of water flow in FIG. 1 is indicated by flow direction 46 in a counterclockwise direction.

In some embodiments, one or more movable objects 50 are disposed inside the interior space 22 in ring 20. Each moveable object 50 is dimensioned to have an outer dimension smaller than the innermost dimension of ring 20 when ring 20 is fully inflated with water or air. As such, moveable object 50 may translate inside ring 20 when water is flowing through ring 20.

For example, as shown in FIG. 1, in some embodiments, a plurality if moveable objects 50 are positioned inside ring 20. The flow of water 46 pushes the objects around the interior of ring 20 in the same direction as the flow of water, causing the objects to appear to be moving inside ring 20. This movement gives the objects 50 a life-like appearance which provides entertainment for children and adults. Additionally, the movement of the objects 50 provides a visual indicator to a user that water is indeed flowing through the ring 20. Movement of the objects 50 is visible to a user because the upper surface on ring 20 is fully or partially transparent in some embodiments.

Moveable objects 50 can take many different forms. In some embodiments, moveable objects 50 include shapes resembling children's toys, such as balls, solid shapes, animals or marine life. In other embodiments, moveable objects 50 include particulates such as glitter. In other embodiments, moveable objects 50 include battery-operated objects with one or more light emitting diodes disposed thereon and configured to produce light and/or sound when moving through ring 50.

Figure 2:
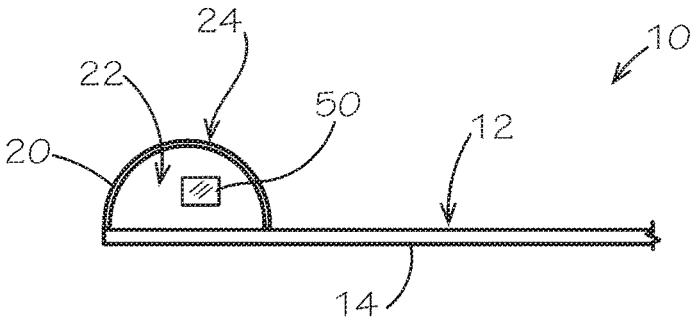
FIG. 2 illustrates a partial cross-sectional view of an embodiment of a splash pad with mobile interior objects.

Ring 50 is attached to base pad 14 as an integral part of base pad 14 or as a separate component that is attached to base pad 14 during manufacture. Ring 50 can take many different shapes. As shown in FIG. 2, ring 20 includes a semi-circular cross-sectional shape, and moveable object 50 is positioned in the interior space 22 between ring 20 and base pad 14. A transparent surface 24 is located on the upper side of ring 20 to allow a user to visually observe moveable object 50 as it travels through ring 20.

Figure 3:
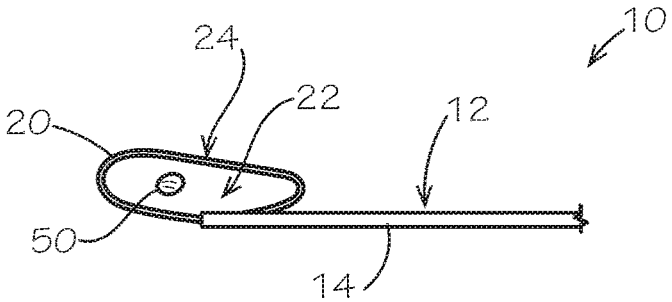
FIG. 3 illustrates a partial cross-sectional view of an embodiment of a splash pad with mobile interior objects.

Referring to FIG. 3, in additional embodiments, ring 20 includes an oblong or oval cross-sectional shape, and ring 20 is attached to base pad 14.

Figure 4:
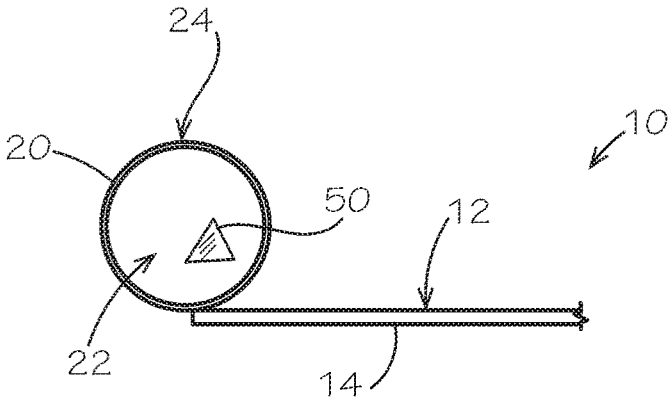
FIG. 4 illustrates a partial cross-sectional view of an embodiment of a splash pad with mobile interior objects.

Referring to FIG. 4, in additional embodiments, ring 20 includes a round cross-sectional shape and is attached to base pad 14 at a position on the bottom tangential edge of the ring 20. Moveable object 50 is positioned in the interior space 22 inside ring 20.

Figure 5:
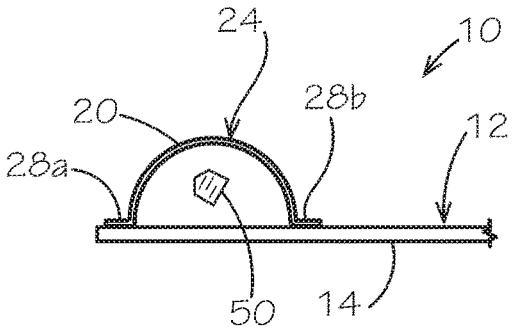
FIG. 5 illustrates a partial cross-sectional view of an embodiment of a splash pad with mobile interior objects.

Referring to FIG. 5, in additional embodiments, ring 20 includes a semi-circular cross-sectional profile having first and second edge flaps 28*a*, 28*b*. First edge flap 28*a* is attached to base pad 14 at a first location, and second edge flap 28*b* is attached to base pad 14 at a different location. Moveable object 50 is positioned in the interior space 22 inside ring 20. Each edge flap 28*a*, 28*b* may be attached to base pad 14 using any suitable attachment, including but not limited to adhesives, integral molding or radio-frequency welding.

Figure 6:
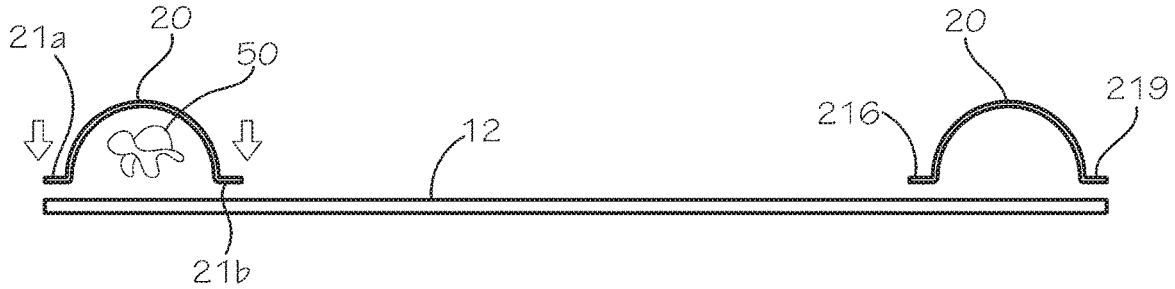
FIG. 6 illustrates an exploded partial cross-sectional view of an embodiment of a splash pad with mobile interior objects.
Figure 7:
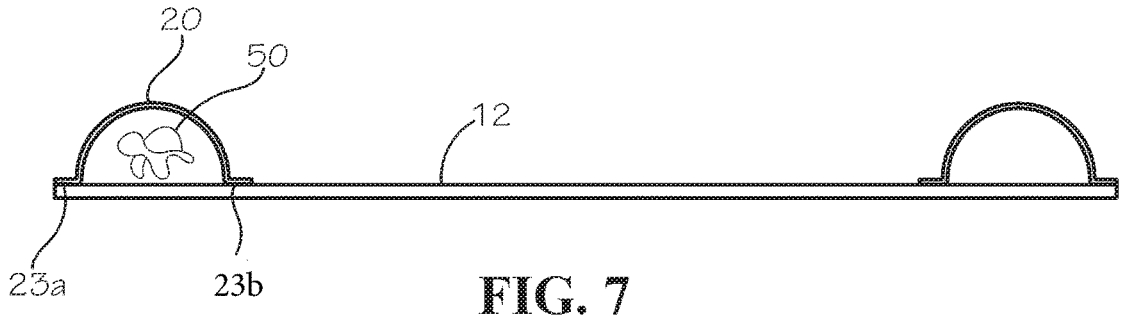
FIG. 7 illustrates a partial cross-sectional view of an embodiment of a splash pad with mobile interior objects.

As shown in FIGS. 6 and 7, in some embodiments, ring 20 includes a semi-circular cross-section and is attached onto the top of base pad 12. For example, in some embodiments, ring 20 includes an outer flange 21*a* and an inner flange 21*b*. Inner and outer flanges 21*a*, 21*b* are pressed against base pad 12 and secured in place using a suitable attachment such as an adhesive, weld or integral molding. An outer seal 23*a* is formed between outer flange 21*a* and base pad 12, and an inner seal 23*b* is formed between inner flange 21*b* and base pad 12. In some embodiments, ring 20 includes a transparent material, and at least one mobile FIG. 50 is positioned between ring 20 and base pad 12 such that the mobile figure is moveable through the interior of the ring 20 when water is flowing through the ring 20.

Figure 8:
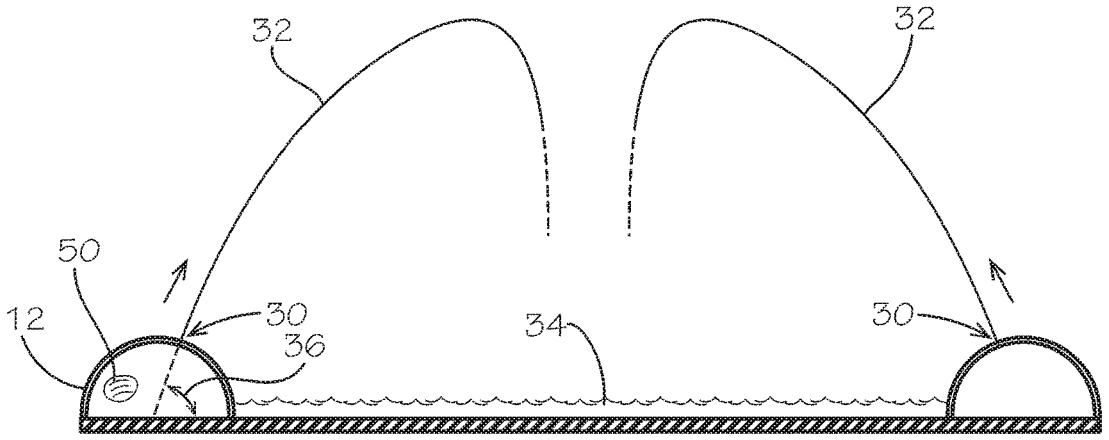
FIG. 8 illustrates a partial cross-sectional view of an embodiment of a splash pad with mobile interior objects.
Figure 9:
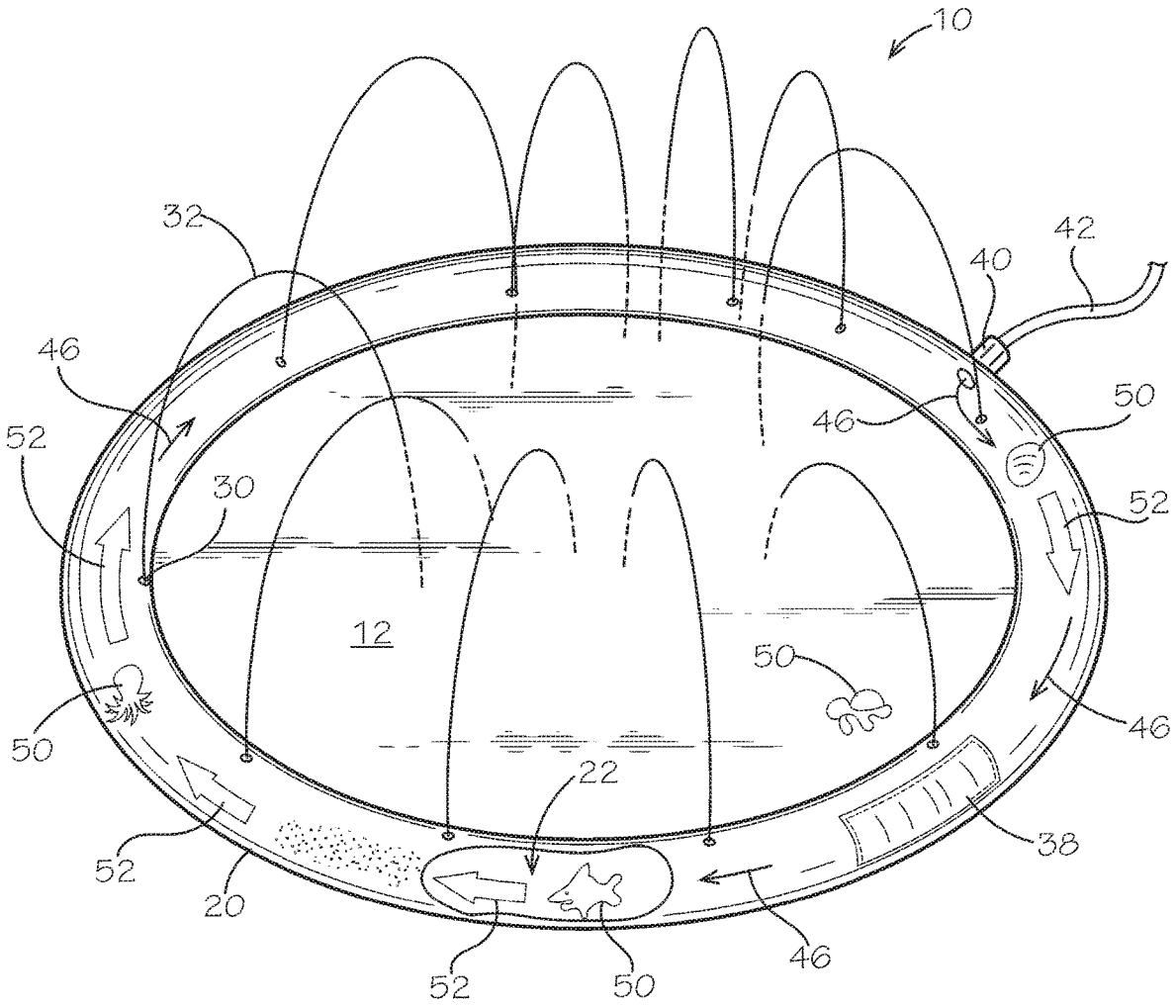
FIG. 9 illustrates a perspective view of an embodiment of a splash pad with mobile interior objects.

As shown in FIG. 8, a plurality of spray orifices 30 are positioned in ring 20 around the perimeter of ring 20. Each spray orifice defines a hole where water from the interior of ring 20 may be ejected due to the water pressure. A spray jet 32 is emitted from each spray orifice 30 during use. The spray jet 32 includes a stream of water directed up into the air over base pad 12. Some of the ejected water may form in a shallow pool 34 on top of base pad 12 and contained partially by ring 20.

Each spray orifice is oriented at a spray angle 36 relative to a horizontal reference plane. The spray angle 36 of each orifice in some embodiments is ninety degrees such that the spray jet 32 is directed straight up into the air. In other embodiments, the spray angle 36 is between about zero degrees and about ninety degrees. In further embodiments, the spray angle 36 is between about thirty degrees and about sixty degrees.

During use, the water flowing into the ring on the splash pad may flow in an counterclockwise direction as shown in FIG. 1, or in a clockwise direction as shown in FIG. 8. For example, as seen in FIG. 8, a hose 42 is connected to a hose fitting 42 on ring 20. Water flows along a water flow direction 46 into the ring 20. Moveable objects 50 positioned inside ring 20 may travel in an object direction 52 along with the flow direction of the water inside ring 20. The water flowing in the interior 22 of ring 20 pushes the objects 50 around in a circle, simulating movement. Additionally, the water is also ejected from numerous orifices 30, forming a plurality of spray jets or spray streams 32. Water from the spray streams 32 collects on splash pad 12. In some embodiments, a door 38 is positioned on ring 20 to allow objects 50 to be inserted into the interior 22 of ring 20 or removed from the interior of ring 20. Door 38 forms a seal between door 38 and ring 20.

Figure 10:
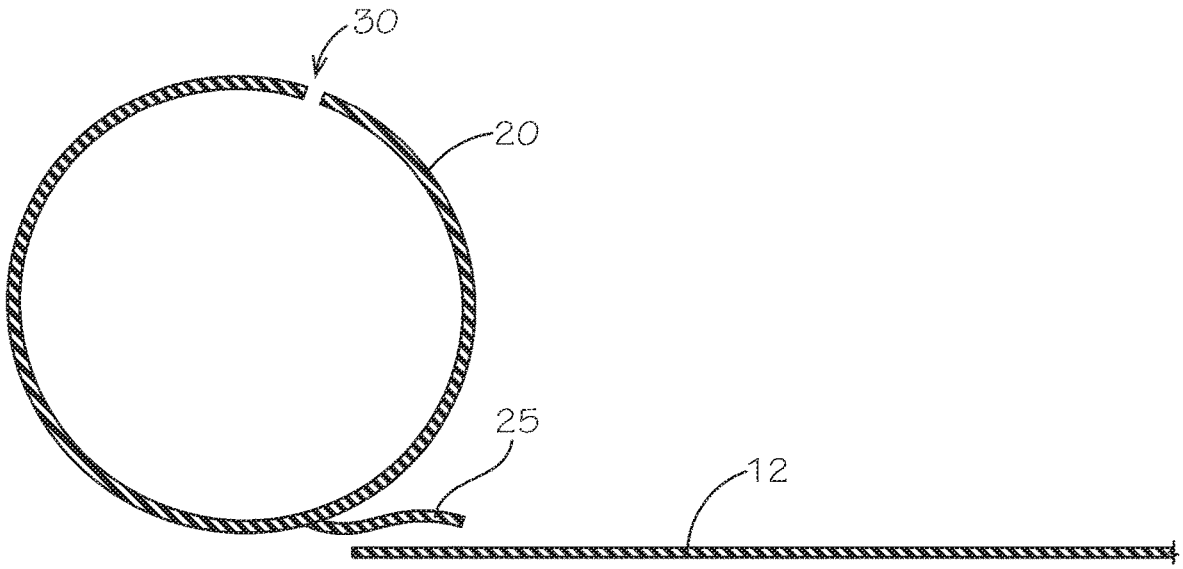
FIG. 10 illustrates an exploded partial cross-sectional view of an embodiment of a splash pad with mobile interior objects.
Figure 11:
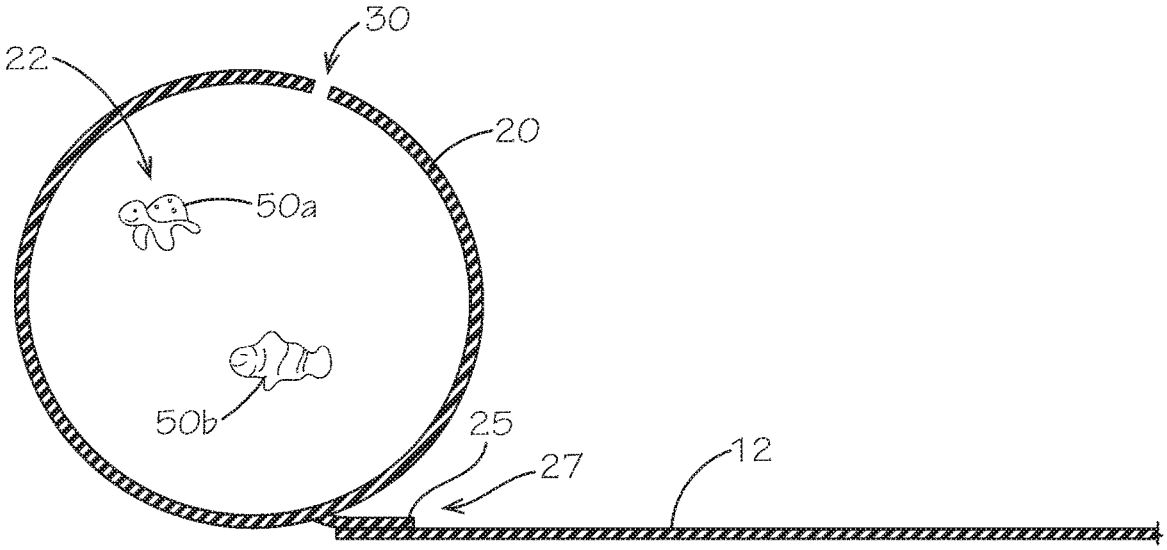
FIG. 11 illustrates a partial cross-sectional view of an embodiment of a splash pad with mobile interior objects.

In some alternative embodiments, ring 20 may be formed from a circular tube that is attached to a flat base bad 12, as shown in a cross-sectional view in FIG. 10. Ring 20 includes an inflatable structure that can be filled with a liquid such as water. One or more spray orifices 30 may be formed in the ring 20. Base pad 12 may be attached directly to the lower surface of ring 20 using any suitable attachment, such as an adhesive, weld or molding process. Additionally, in some embodiments, a flap 25 protrudes from the lower surface of ring 20, and flap 25 is attached to base pad 12 at a ring joint 27, as shown in FIG. 11.

In further embodiments, the present disclosure provides a method of manufacturing a toy, comprising the steps of (a) providing a water inflatable ring and a splash pad base; (b) positioning a plurality of moveable objects inside the ring; (c) attaching the ring to the base; (d) introducing a flow of water into the ring; and (e) translating the moveable objects inside the ring along with the flow of water.

Thus, although there have been described herein particular embodiments of a new and useful apparatus and methods, it is not intended that such references be construed as limitations on the scope of the present invention except as set forth in the following Claims.

What is claimed is:

1. A splash pad apparatus, comprising:

a base pad having a playing surface;

a ring positioned on the base pad, the ring including a first edge flap attached to the base pad at a first location, a second edge flap attached to the base pad at a second location, wherein the second location is different than the first location, and an interior space configured to receive a liquid, wherein the ring is inflatable using the liquid;

a plurality of orifices defined in the ring, wherein each orifice ejects a stream of the liquid when the liquid flows through the interior space; and a first moveable object disposed inside the interior space in the ring, wherein the first moveable object travels inside the ring when the liquid flows through the interior space in the ring.

2. The apparatus of claim 1, further comprising a second moveable object disposed inside the interior space in the ring.

3. The apparatus of claim 2, wherein the second moveable object travels inside the ring when the liquid flows through the interior space in the ring.

4. The apparatus of claim 3, further comprising a hose fitting disposed on the ring.

5. The apparatus of claim 4, further comprising a hose inlet on the ring in fluid communication with the hose fitting.

6. The apparatus of claim 5, wherein liquid enters the interior space in the ring via the hose inlet.

7. The apparatus of claim 1, wherein the ring includes a transparent surface.

8. The apparatus of claim 7, wherein the moveable object is visible through the transparent surface on the ring.

9. The apparatus of claim 8, wherein the ring includes a semi-circular cross-sectional profile.

10. The apparatus of claim 1, wherein the first edge flap and the second edge flap are each attached to the base pad using an adhesive.

11. The apparatus of claim 10, wherein the first edge flap and the second edge flap are each attached to the base pad using welding.

12. The apparatus of claim 1, wherein the first edge flap forms an outer seal with the base pad, and the second edge flap forms an inner seal with the base pad.

13. The apparatus of claim 1, wherein the ring comprises a continuous cross-sectional profile, and the ring is attached to the base pad.

14. The apparatus of claim 1, wherein the ring includes a polyvinylchloride.

15. The apparatus of claim 1, wherein each orifice of the plurality of orifices ejects the stream of the liquid onto the base pad.

16. The apparatus of claim 15, wherein each orifice of the plurality of orifices ejects the stream of the liquid at an angle between third degrees and sixty degrees.

17. The apparatus of claim 1, wherein the ring further comprises a door positioned on the ring, wherein the door forms a seal between the door and the ring, and wherein one or more moveable objects are insertable into and removable from the ring via the door.

* * * * *